US009725145B2

(12) United States Patent
Moeller et al.

(10) Patent No.: US 9,725,145 B2
(45) Date of Patent: Aug. 8, 2017

(54) DIVING EQUIPMENT

(75) Inventors: Rudolf Moeller, Gehrden (DE); Johan Forsslund, Stockholm (SE); Janett Schulz, Hannover (DE); Heinz-Hermann Meyer, Seelze (DE); Isabell Hubein, Hannover (DE); Riccardo Luessenhop, Neustadt am Rübenberge (DE)

(73) Assignee: Aventics GmbH, Laatzen (DE)

( * ) Notice: Subject to any disclaimer, the term of this patent is extended or adjusted under 35 U.S.C. 154(b) by 640 days.

(21) Appl. No.: 14/131,703

(22) PCT Filed: Jun. 20, 2012

(86) PCT No.: PCT/EP2012/002587

§ 371 (c)(1),
(2), (4) Date: May 19, 2014

(87) PCT Pub. No.: WO2013/007336

PCT Pub. Date: Jan. 17, 2013

(65) Prior Publication Data

US 2014/0283838 A1 Sep. 25, 2014

(30) Foreign Application Priority Data

Jul. 9, 2011 (DE) ..... 10 2011 107 026

(51) Int. Cl.
*B63C 11/24* (2006.01)
*B63C 11/22* (2006.01)
(Continued)

(52) U.S. Cl.
CPC ..... *B63C 11/2245* (2013.01); *A62B 7/02* (2013.01); *A62B 9/022* (2013.01); *B63C 11/08* (2013.01); *B63C 2011/085* (2013.01)

(58) Field of Classification Search
CPC ..... B63C 11/08; B63C 11/2245; B63C 2011/085; A62B 7/02; A62B 9/022
See application file for complete search history.

(56) References Cited

U.S. PATENT DOCUMENTS 3,605,418 A 9/1971 Levine
3,952,349 A * 4/1976 Erath ..... B63G 8/14 114/326
(Continued)

FOREIGN PATENT DOCUMENTS

FR 1 248 516 11/1960
WO 2007/058615 A1 5/2007
WO 2008/143581 A1 11/2008

OTHER PUBLICATIONS

International Search Report corresponding to PCT Application No. PCT/EP2012/002587, mailed May 6, 2013, (German and English language document) (11 pages).

*Primary Examiner* — Benjamin Fiorello
(74) *Attorney, Agent, or Firm* — Maginot Moore & Beck LLP

(57) ABSTRACT

Diving equipment includes a compressed air bottle connected to a breathing apparatus and an inflatable jacket via which buoyancy is balanced by the jacket being connected to the compressed air bottle to be inflated or to an outlet to be deflated. A monitoring device is activated via a control valve as a function of surrounding water pressure and has a time monitoring unit which, after the expiry of a defined time and in the absence of breathing activity in the breathing apparatus, changes to emergency operation and activates an emergency valve via a control line connecting the jacket to the compressed air bottle to force inflation of the jacket. Actuation of at least one regulating valve is influenced during a dive by the monitoring device and/or the control valve. In manual activation, the jacket is inflated via the
(Continued)

inflation valve, and the compressed air is bled via the outlet valve.

8 Claims, 5 Drawing Sheets

(51) Int. Cl.

| | |
|---|---|
| ***B63C 11/08*** | (2006.01) |
| ***A62B 7/02*** | (2006.01) |
| ***A62B 9/02*** | (2006.01) |

(56) References Cited

U.S. PATENT DOCUMENTS

| | | | | | |
|---|---|---|---|---|---|
| 4,108,171 | A * | 8/1978 | Nyman | A61M 16/0045 | 128/202.14 |
| 4,950,107 | A * | 8/1990 | Hancock | B63C 11/26 | 116/112 |
| 4,968,277 | A * | 11/1990 | Parish | B63C 9/18 | 441/10 |
| 5,570,688 | A * | 11/1996 | Cochran | A62B 9/006 | 128/201.27 |
| 5,823,713 | A * | 10/1998 | Biran | B63C 11/2245 | 405/186 |
| 2002/0127062 | A1 * | 9/2002 | Biran | B63C 11/02 | 405/186 |

* cited by examiner

DIVING EQUIPMENT

This application is a 35 U.S.C. §371 National Stage Application of PCT/EP2012/002587, filed on Jun. 20, 2012, which claims the benefit of priority to Serial No. DE 10 2011 107 026.9, filed on Jul. 9, 2011 in Germany, the disclosures of which are incorporated herein by reference in their entirety.

BACKGROUND

The disclosure relates to an article of diving equipment, including a compressed air bottle, which is connected to a breathing apparatus, and an inflatable jacket by means of which buoyancy can be balanced out by the jacket being connectable in normal mode to the compressed air bottle for inflation or to an outlet for letting out air, wherein there is provided a control device which is activatable by means of a control valve in dependence on a surrounding water pressure and which has a time control unit which, after the expiry of a defined time and if there is an absence of breathing activity in the breathing apparatus, transfers into an emergency mode and, by means of a control line, activates an emergency valve, which, at the same time, connects the jacket to the compressed air bottle and consequently forces the jacket to inflate.

Modern diving equipment usually includes a buoyancy compensating jacket, also called a BCD (buoyancy control device), which serves at the same time as a supporting structure for a compressed air bottle of the diving equipment and by means of which the diver is able to regulate and balance out his buoyancy in a precise manner at any depth by means of blowing in or letting out air.

In this case, a buoyancy compensating jacket is generally provided with several valves which are provided for controlling the blowing in or letting out of air into or out of an air lock of the jacket and frequently also for introducing emergency measures. Said emergency measures are introduced, for example, in the event of a defined amount of compressed air in the compressed air bottle being fallen below or in the event of an absence of breathing activity on the part of the diver.

Diving equipment which, in this case, is composed of a buoyancy compensating jacket and a compressed air bottle as well as a valve arrangement for controlling a compressed air supply from the compressed air bottle to the buoyancy compensating jacket, proceeds from WO2007/058615 A1. In this case, buoyancy of a diver is balanced out by means of the buoyancy compensating jacket by the jacket, in normal mode, either being inflated by means of the compressed air bottle or compressed air being let out of the jacket. The valve arrangement, in this case, includes a control device, by means of which it is possible to changeover from normal mode to emergency mode. For this purpose, there is provided a control valve which activates the control device in dependence on a surrounding water pressure. The control device, in this case, has a time control unit which is composed of a diaphragm valve and delaying means. When the control device is activated by means of the control valve, the diaphragm valve is acted upon with compressed air from the compressed air bottle and directs the compressed air by means of a first working line further to the delaying means. If the diver then takes a breath from the breathing apparatus, the compressed air directed to the diaphragm valve is forwarded by means of a second working line to the delaying means, the supplying of pressure by means of the second working line causing the delaying means to be reset. However, if the diver does not take a breath from the breathing apparatus over a period defined by the delaying means, the delaying means, by means of a control line, thus activate an emergency valve which, in this case, connects the jacket to the compressed air bottle and consequently forces inflation of said jacket. As a consequence, the supposedly non-breathing diver is then conveyed back to the surface of the water.

Proceeding from the above-described prior art, it is now the object of the present disclosure to provide an article of diving equipment where operations of the control device are able to be influenced manually by the diver, said influencing, in this case, having to be producible by the diver in as easy a manner as possible.

SUMMARY

According to the disclosure, an article of diving equipment includes a compressed air bottle, which is connected to a breathing apparatus, and an inflatable jacket by means of which buoyancy can be balanced out. For this purpose, the jacket can be connected in normal mode to the compressed air bottle for inflation or air is let out of the jacket by means of an outlet. In addition, there is provided a control device which is activated by means of a control valve in dependence on a surrounding water pressure and has a time control unit, said time control unit, after the expiry of a defined time and if there is an absence of breathing activity on the part of the diver in the breathing apparatus, transferring into an emergency mode. At the same time, an emergency valve is actuated by means of a control line such that the jacket is connected to the compressed air bottle and the jacket is forced to inflate.

In terms of the disclosure, the time control unit is composed, in this case, in particular of a fill aperture, a control volume and a drain valve, the control volume being filled continuously with compressed air from the compressed air bottle via the fill aperture from the moment the control device is activated by the control valve and at the same time being connected to a control line of the emergency valve. From the moment a defined pressure in the control volume is obtained, said control volume provides for a corresponding activation of the emergency valve which, as described above, forces inflation in the jacket. When the diver draws a breath in the breathing apparatus, in contrast the drain valve is activated and at the same time enables the control volume to be emptied. As a consequence, the time control unit is reset by emptying the volume at every breath taken. In terms of the disclosure, the control device is activated by the control valve by the surrounding water pressure being set by the control valve in relation to a reference pressure, in a preferred manner to atmospheric pressure, and when a pressure threshold is exceeded by the surrounding water pressure, the control volume of the time control unit is connected to the compressed air bottle.

The disclosure then includes the technical teaching that an inflation valve and an outlet valve are provided, wherein the inflation valve, when activated manually by the diver, connects the jacket to the compressed air bottle and the outlet valve, when actuated manually by the diver, connects the jacket to the outlet to let air out of the jacket. Consequently, a balancing out is performed by correspondingly filling or emptying the jacket by means of said valves. As a characteristic, there is additionally provided at least one regulating valve, by means of the respective activation of which during the diving operation the control device and/or the control valve is able to be influenced. In other words, therefore, there is provided at least one additional regulating valve by means of which, when activated by the diver, the control valve is influenced. As an alternative to this or also in addition to it, the control device is influenced when the at least one regulating valve is activated. The advantage of a development of this type, in this connection, is that the diver, by means of the at least one regulating valve, is able to influence the activating of the control device and/or the monitoring function of the control device and is consequently able to adapt these in a targeted manner to the conditions present in the respective diving operation.

In contrast to this, in the case of WO2007/058615 A1 it is not possible to influence the control device or the control valve of the buoyancy compensating jacket. The result of this, however, is that when a time range in the time control unit is exceeded without a breath being taken in the breathing apparatus, for example as a result of the diver intentionally holding his breath or in the case of certain exercises during dive training, the jacket is always inflated and the diver returned to the surface of the water. Once the jacket is inflated in this connection, this process can no longer be stopped until the surface of the water is reached. Neither is it possible to reset the time registration in the delaying means.

According to an advantageous development of the disclosure, the respective activation of the at least one regulating valve is coupled with an activation of the inflation valve and/or with an activation of the outlet valve at least from a defined degree. The advantage of this is that it is also possible to influence the control device and/or the control valve to activate the control device by means of the elements which are already usually provided within the region of a buoyancy compensating jacket in the form of an inflation valve and an outlet valve without the separate control elements having to be provided. The diver is also able to undertake influencing the safety functions of the respective buoyancy compensating jacket with the valves which are familiar to him, which simplifies the operation in a corresponding manner and prevents the diver being overtaxed in the individual case on account of a large number of control elements. In addition, with corresponding association with the inflation valve and with the outlet valve, simple control, which is able to be performed in an intuitive manner by the operating diver, is possible. Finally, it is also possible for the interventions in the safety functions of the jacket to be carried out by a dive partner as they are easily accessible from the outside and are able to be operated in an easily visible manner. In the end, production expenditure can also be reduced when realizing an article of diving equipment as a saving can be made on separate buttons which would otherwise have to be provided to reset the safety functions.

In a further development disclosed herein, the outlet valve can be activated by means of a control element, wherein in a first half of a control region of the control element a control movement of the control element is coupled purely with a displacement of the outlet valve and from a second half of the control region the control movement is additionally coupled with a displacement of the at least one control valve. By means of a development of this type, it is possible to control, by means of the degree of activation of the control element, whether just an actuation of the outlet valve for balancing out buoyancy or whether additionally also the control device is to be influenced in order to carry out the aforementioned functions, such as resetting and/or aborting inflation of the jacket. By means of the type of the actuating of the control element, the diver can therefore control centrally whether he would like to carry out the functions in normal mode or whether, in addition to this, he would like to perform modifications to the control device.

According to in the disclosure, the at least one control valve is developed as a shut-off valve which is provided between the emergency valve and the compressed air bottle and, in an activated position, interrupts the connection between the emergency valve and the compressed air bottle. In a preferred manner, the shut-off valve, in this case, is coupled with a movement of the outlet valve from a defined activation degree of the outlet valve. As a result, inflation of the jacket introduced in emergency mode can consequently be aborted by interrupting the pressure supply to the emergency valve by means of the shut-off valve. With coupling with the outlet valve, the diver can perform this interruption manually by operating the outlet valve as the shut-off valve is coupled with the outlet valve at least from a certain degree of activation of the outlet valve. In a preferred manner, the shut-off valve, in this connection, is developed as a 2/2 directional control valve which, in a starting position, permits compressed air to flow to the emergency valve and, in an activated position, interrupts the connection. In addition, when coupled to the outlet valve, the shut-off valve is connected to the outlet valve in particular in a mechanical manner, for example by means of a corresponding linkage, in terms of the disclosure, however, pneumatic, hydraulic or electric coupling is also conceivable.

Corresponding to a further development disclosed herein, the at least one regulating valve is realized as a reset valve, to which a working line branches from the control line of the emergency valve and which, in an activated position, relieves the pressure from the control line. In particular, said reset valve is then coupled with a movement of the outlet valve at least from a defined degree of activation of the outlet valve. In an advantageous manner, a time lapse procedure in the time control unit is reset as a result of the pressure relief as a result of the reset valve being activated. The timing in the time control unit, which runs after the latest breath is taken in the breathing apparatus, can therefore be restarted by the reset valve, the diver being able to control said restart manually by operating the outlet valve when it is coupled with the outlet valve. Where the time control unit is developed with a volume and a directional control valve, the volume is emptied when the reset valve is activated, which brings about the desired resetting. The reset valve, in terms of the disclosure, is coupled in particular in a mechanical manner with the outlet valve, but can also be connected to the movement of the outlet valve just as well in a pneumatic, hydraulic, electric or in any other manner. Where a reset valve is provided in addition to the shut-off valve described beforehand, said two valves can be coupled with the outlet valve by means of a common linkage such that actuation of the outlet valve brings about activation of the shut-off valve and of the reset valve at least from a certain degree. In a preferred manner, the reset valve is additionally realized as a 2/2 directional control valve.

According to the disclosure, the at least one regulating valve is realized as a reset valve which is placed between the control valve and the compressed air bottle, wherein, in a starting position, the reset valve connects a working line of the control valve to the compressed air and, in an activated position, relieves the pressure from the working line of the control valve. In a preferred manner, the reset valve, in this case, is activated together with the inflation valve at least from a defined degree of activation such that, as a result, a supply to the control valve is connected in an unpressurized manner. The advantage of a development of this type, in this connection, is that, as a result of providing the reset valve and the unpressurized connecting of the supply to the control valve, a monitoring function of the control device can be switched on again after an interruption, the diver being able to perform said switching on manually by means of the inflation valve by activating the inflation valve. In a preferred manner, coupling between the inflation valve and the reset valve is once again developed, in this connection, in a mechanical manner, but, in terms of the disclosure, can also be provided in a hydraulic, pneumatic, electric or another manner. In addition, the reset valve is developed in particular as a 3/2 directional control valve which, in a starting position, connects an inflow to the control valve to the compressed air bottle and, in an activated position, connects the inlet to the control valve to an unpressurized line to the jacket.

In a further development, the at least one regulating valve is formed by a shut-off valve which is arranged between the control valve and the time control unit. In this case, the shut-off valve can be moved into a shut-off position in which a connection between the time control unit and the control valve is interrupted, whereas the shut-off valve produces the connection between the time control unit and the control valve in a starting position into which the shut-off valve can be transferred by means of a control line which is connected to an outlet side of the inflation valve. The advantage of a development of this type, in this connection, is that a temporary interruption of the breathing monitoring function can be provided by means of the shut-off valve, the monitoring by the time control unit then being resumed from a renewed activation of the inflation valve. Thus, for example, when taking underwater photographs and the connected holding of breath as is usual in this connection, the monitoring is able to be switched off in a targeted manner in order to avoid unwanted inflation of the jacket.

According to the disclosure, the at least one regulating valve is formed by a bypass valve which is transferable into an operating position in which a line, which branches from a control volume of the time control unit, is connected to an additional volume. In contrast, the bypass valve interrupts the connection between the line and the additional volume in a starting position into which the bypass valve is transferable by means of a control line which is connected to an outlet side of the inflation valve. As a result, a time window, after the expiry of which and the lack of breathing activity on the part of the diver the emergency measures are introduced, is able to be increased in a targeted manner by a larger overall volume being formed as a result of connecting the additional volume to the control volume, which, in a subsequent obtaining of a trigger pressure, results in transferring the emergency valve into the emergency position.

According to a further, advantageous embodiment, a pre-test valve is provided with an actuating element, wherein the pre-test valve, in an activated position, connects a control line of the control valve to the compressed air bottle such that the control valve activates the control device. As a result of providing the pre-test valve, regular functioning of the control device is consequently able to be checked as early as on the surface of the water prior to a diving operation. Otherwise, activation of the control device is only performed by the control valve when a corresponding surrounding water pressure is reached. As a result of the pressurization of a control line of the control valve, said pressure control is now bridged and consequently the time control unit of the control device is already connected to the compressed air bottle on the surface of the water. As a result, it can then be checked whether the time control unit of the control device and in further succession also the emergency valve for emergency inflation of the jacket are functioning properly. In combination with providing an aforementioned reset valve in the region of the inflation valve, said checking function is able to be aborted again by an inlet to the control valve being connected in an unpressurized manner by the reset valve. In a preferred manner, an actuating element of the pre-test valve is developed, in this case, as a pushbutton but can also be realized in another manner within the framework of the disclosure.

The disclosure is not restricted to the specified combination of the features described herein. Over and above this, there are also possibilities to combine together individual features, also insofar as they proceed from the disclosure, the following description of an embodiment or directly from the drawings.

BRIEF DESCRIPTION OF THE DRAWINGS

Further advantageous developments of the disclosure are produced from the following description of a preferred embodiment of the disclosure, which refers to the figures shown in the drawings, in which.

DETAILED DESCRIPTION

Figure 1:
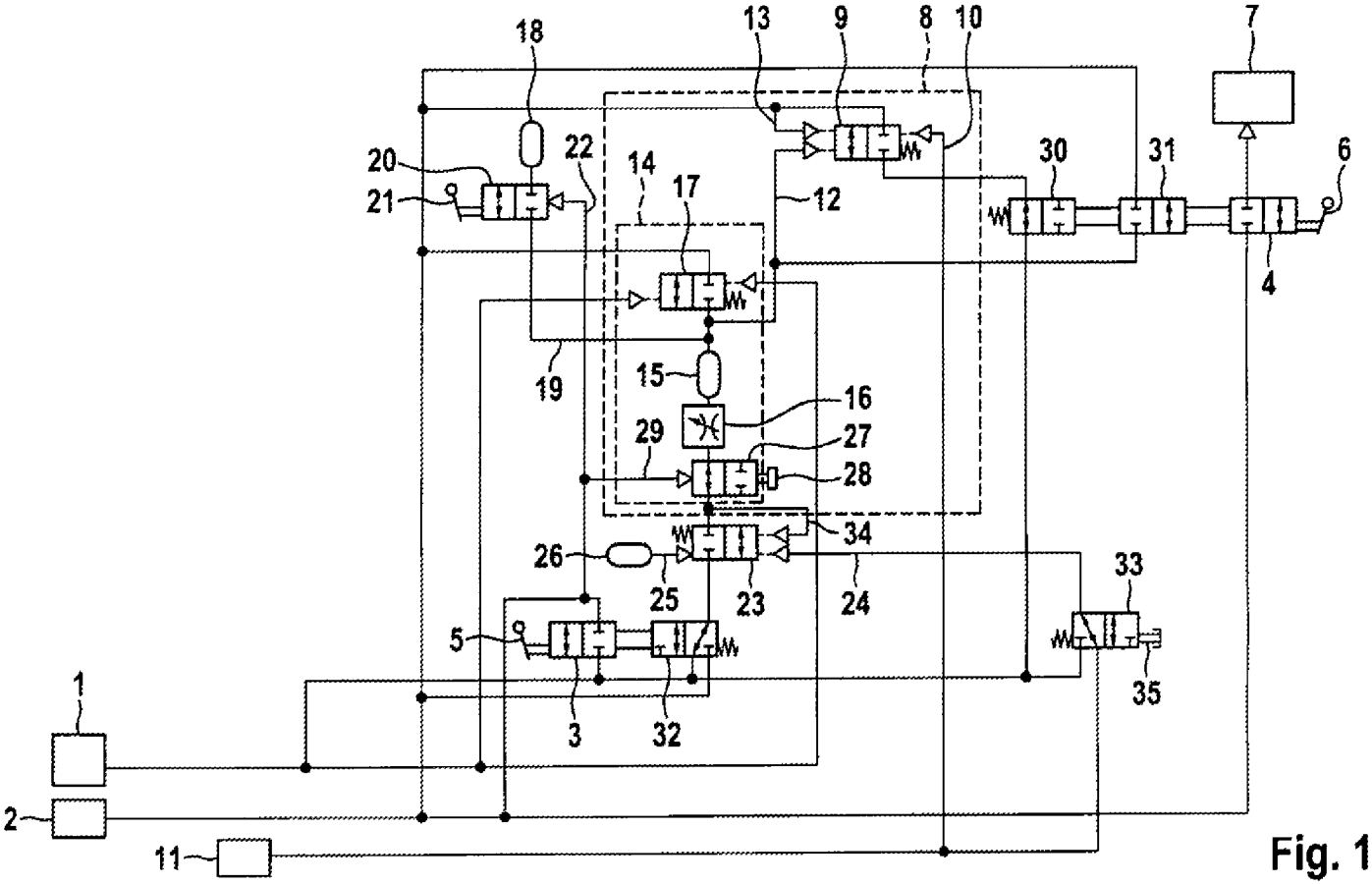
FIG. 1 shows a block diagram of an article of diving equipment in a preferred development of the disclosure.
Figure 2:
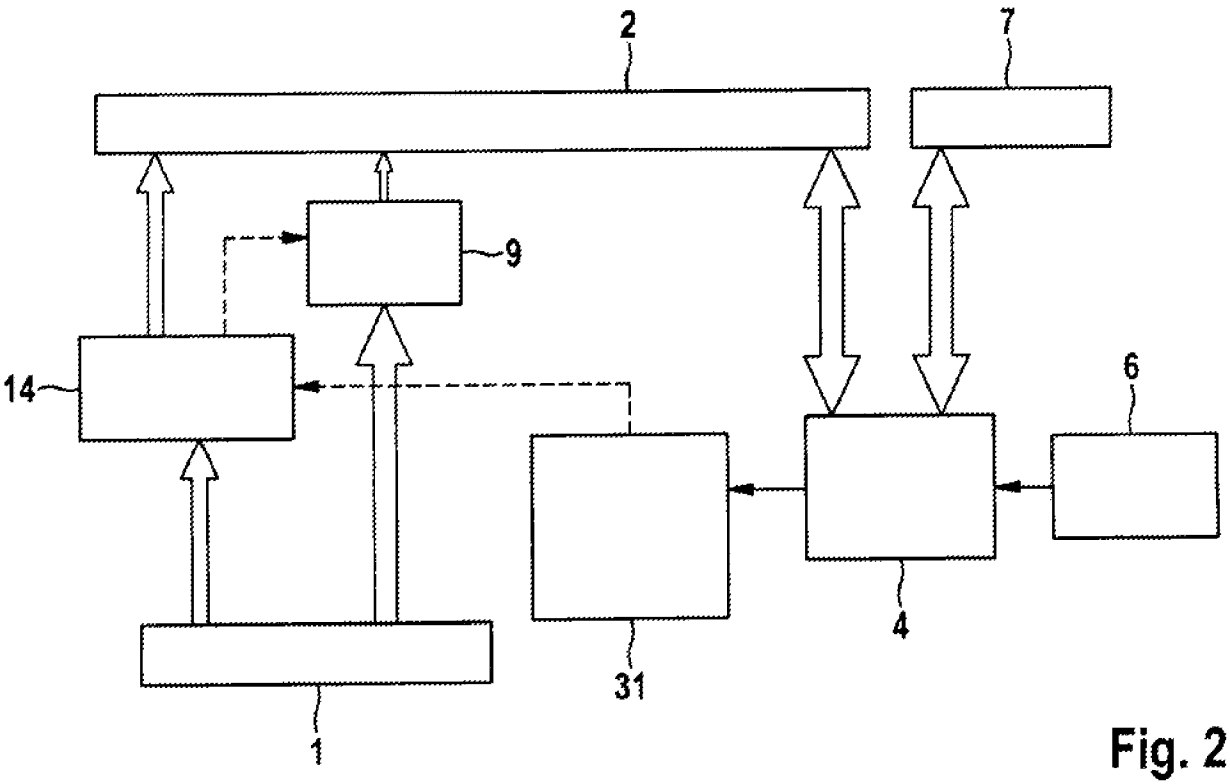
FIG. 2 shows a functional diagram for resetting a time lapse procedure of a time control unit of the diving equipment according to FIG. 1.
Figure 3:
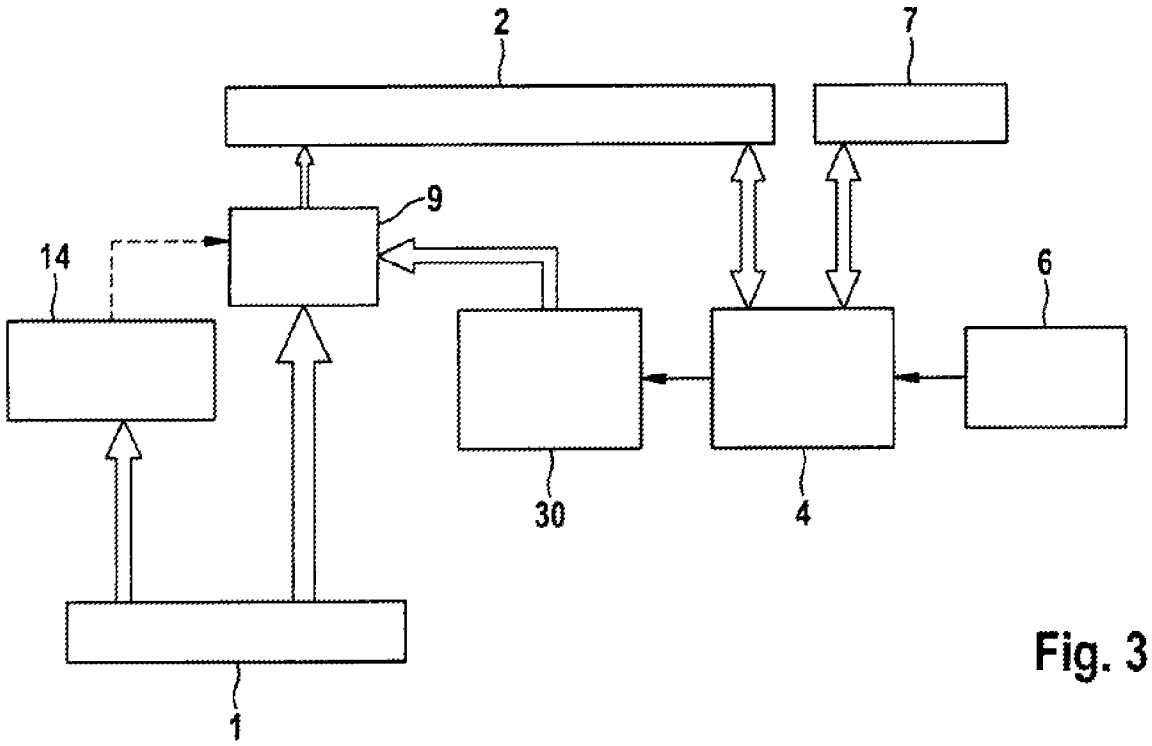
FIG. 3 shows a functional diagram of an interruption of an emergency inflation of a jacket of the diving equipment according to FIG. 1.
Figure 4:
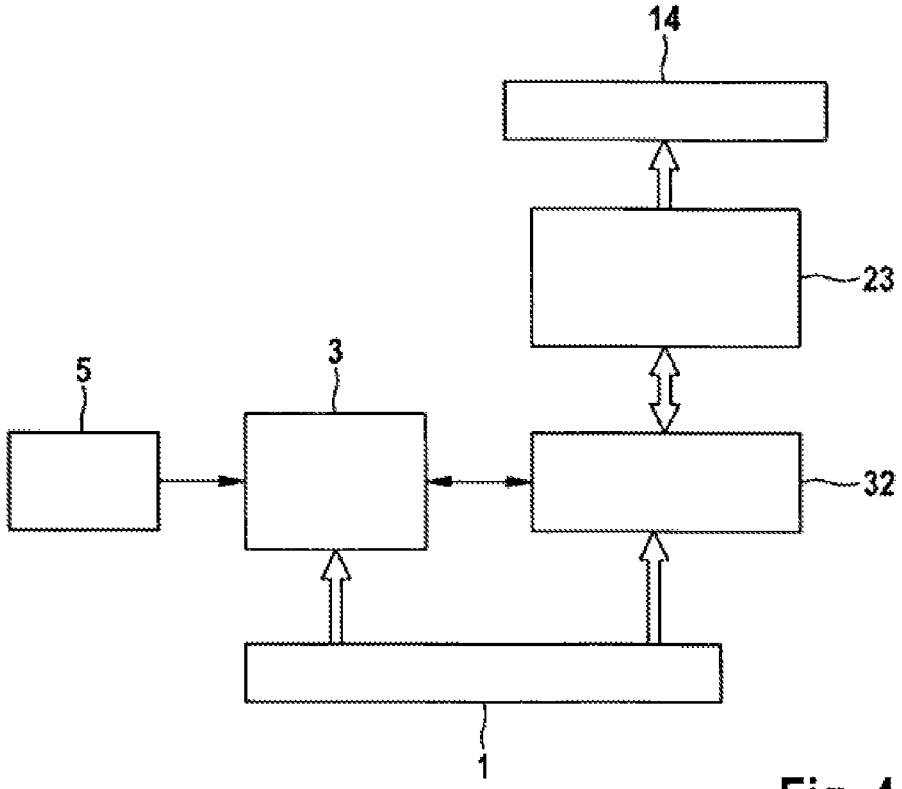
FIG. 4 shows a functional diagram with reference to a resetting of a control device of the diving equipment according to FIG. 1.
Figure 5:
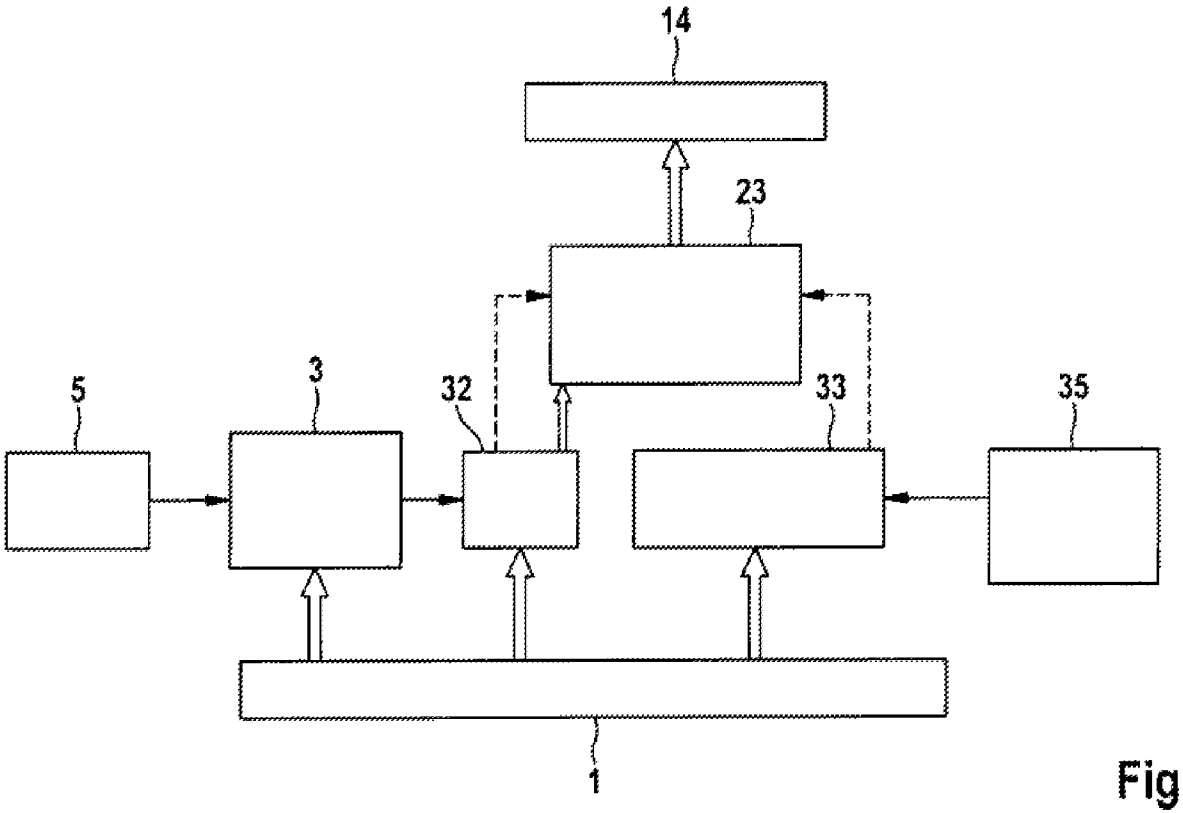
FIG. 5 shows a functional diagram for resetting a pre-function test of the diving equipment according to FIG. 1.

FIG. 1 shows a block diagram of an article of diving equipment in one embodiment of the disclosure. Said diving equipment, in this connection, includes a compressed air bottle 1 which supplies a breathing apparatus—not shown any further in the present case—with compressed air such that a diver is able to be provided with breathable air under water. In addition, there is provided an inflatable jacket 2 which is provided with an air lock—not shown any further in the present case either—which is able to be inflated with compressed air as a result of the compressed air bottle 1 or from which air is able to be let out. Corresponding to the supplying or letting out of air, buoyancy of a diver can be balanced out by means of the jacket 2 by being able to provide an increase by supplying a corresponding amount of air or a reduction by letting air out.

In normal mode, the supplying of air into and letting air out of the jacket 2, in this connection, is controlled by interposed valves in the form of an inflation valve 3 and an outlet valve 4 which, in each case, can be activated by the diver by means of an associated control element 5 or 6, said control elements 5 or 6 being developed here in each case as pushbuttons. Both the inflation valve 3 and the outlet valve 4, in this case, are realized as 2/2 directional control valves and, by means of an associated spring, are prestressed into the starting position shown in this case, from which they are able to be moved into an operating position by the respectively associated control element 5 or 6. In said operating position, the inflation valve 3 then connects the compressed air bottle 1 to the jacket 2 such that the jacket 2 is inflated as a result of compressed air being supplied. When the control element 6 is activated and the outlet valve 4 is transferred into the operating position, the jacket 2, in contrast, is connected to a mouthpiece 7, by means of which compressed air can escape out of jacket into the surrounding area and consequently compressed air can be let out of the jacket 2. In this case, however, it is also possible to fill the jacket 2 manually in the individual case by means of the mouthpiece 7. By operating the two valves 3 and 4 in a corresponding manner, the diver can therefore balance out his buoyancy corresponding to the filling or emptying of the jacket 2.

In addition, the diving equipment according to the disclosure has a control device 8, by means of which a lack of breathing activity on the part of the diver in the breathing apparatus can be detected and, in emergency mode, inflation of the jacket 2 can be forced such that the diver is conveyed back to the surface of the water as a result of the inflating. For this purpose, the control device has an emergency valve 9 which, in the present case, is also developed as a 2/2 directional control valve and, in an operating position, connects the compressed air bottle 1 directly to the jacket 2 such that the jacket 2 is inflated. In the starting position of the emergency valve 9 shown in this case, however, said connection has been interrupted, the emergency valve 9 being prestressed into said starting position by means of an associated spring element and as a result of pressurization by means of a control line 10. The control line 10, in this connection, is supplied with the currently surrounding water pressure by means of a pressure connection 11. In opposition to the spring element and the control line 10, the emergency valve 9 can be displaced into the operating position and held there as a result of corresponding pressure in two further control lines 12 and 13, the control line 12 being connected to a time control unit 14, whilst the control line 13 is connected to the outlet side of the emergency valve 9 and the supply to the jacket 2. To move the emergency valve into the operating position, therefore, a pressure in the control line 12 has to exceed a pressure in the control line 10 and a pressure produced by the spring element. If then the emergency valve 9 is moved once into the operating position, it is held in said position by the control line 13 as a result of the pressure then prevailing.

By means of the time control unit 14, if there is a lack of breathing activity on the part of the diver over a defined period, the control line 12 is acted upon with a pressure that is suitable to open the emergency valve 9. Said time control unit 14 includes a control volume 15 which is filled continuously with pressurized air by means of a fill aperture 16 from the moment the control device 8 is activated, the control volume 15 being connected to the control line 12 of the emergency valve 9. From the moment a certain pressure is reached in the control volume, at the same time an operating pressure for displacing the emergency valve 9 into the operating position is reached. A drain valve 17, which is developed as a 2/2 directional control valve and which, with breathing activity on the part of the diver and a resultant pressure drop in the line system connected to the compressed air bottle 1, is moved out of the starting position shown into an operating position, is additionally provided on the outlet side of the control volume 15. The control volume 15 is then emptied in the operating position. In this case, corresponding to the choice of a suitable volume of the control volume 15 and a throttling by means of the fill aperture 16, a time range can be defined, after the expiry of which an emergency mode is introduced by the control device 8.

Said time range can, however, be extended in a targeted manner by an additional volume 18 being added to the control volume 15. For this purpose, a line 19, which is connectable to the additional volume 18 by means of an interposed bypass valve 20, branches off on the outlet side of the control volume 15. Said bypass valve 20 is developed as a 2/2 directional control valve, the line 19 being separated from the additional volume 18 in the starting position of the bypass valve 20 shown. The bypass valve 20 can then be moved in a targeted manner by means of an actuating element 21, in the present case in the form of a pushbutton, into an operating position in which the line 19 and the additional volume 18 are connected together such that fluid is able to flow into the additional volume 18. This results in the volume between the fill aperture 16 and the drain valve 17 increasing and consequently also the operating pressure for displacing the emergency valve 9 into the operating position subsequently being obtained. A control line 22, which is connected to an outlet side of the inflation valve 3, is provided for resetting the bypass valve 20 such that the bypass valve 20 is transferred into the starting position separating the additional volume 18 from the line 19 as soon as the inflation valve 3 is activated.

A control valve 23, which activates the control device 8 in dependence on the currently surrounding water pressure, is connected upstream of the time control unit 14 for operating the control device 8. For this purpose, the control valve 23 is connected, on the one hand, to the pressure connection 11 by means of a control line 24 in normal mode and is consequently acted upon with the surrounding water pressure by means of said control line 24 and, on the other hand, is connected by means of another control line 25 to a reference volume 26 in which a reference pressure, in a preferred manner atmospheric pressure, prevails. In the starting position shown, the control valve 23, which is developed in the present case as a 2/2 directional control valve, separates the time control unit 14 located behind it from an inlet, the control valve 23 then, however, in an operating position connecting said inlet to the time control unit 13 as soon as the surrounding water pressure has exceeded the pressure in the reference volume 26 and a pressure provided by a spring element of the control valve 23. In normal mode, the inlet, in this case, is connected to the compressed air bottle 1. As a consequence, therefore, the control device 8 is activated by the control valve 23 from the moment a defined water depth is reached.

However, the operating of the control device 8 and consequently also the breathing monitoring function of the time control unit 14 can be temporarily terminated by the connection between the fill aperture 16 of the time control unit 14 and the control valve 23 being interrupted by means of a shut-off valve 27. Said shut-off valve 27, in this case, is arranged between the fill aperture 16 and the control valve 23 and is realized in the present case as a 2/2 directional control valve. In the starting position shown, the shut-off valve 27 enables fluid to flow from the control valve 23 to the fill aperture 16 as soon as the surrounding water pressure has exceeded the above-explained pressure threshold. By means of an operating element 28 in the form of a pushbutton, the shut-off valve 27, however, can be transferred in a targeted manner into an operating position in which fluid is prevented from flowing to the fill aperture 16 and accordingly no monitoring of the breathing activities by the time control unit 14 takes place. The shut-off valve 27 is reset by means of a control line 29 which, as the control line 22 already, is connected to an outlet side of the inflation valve 3. Accordingly, the shut-off valve 27 is transferred into the starting position connecting the control valve 23 and the fill aperture 16 as soon as the inflation valve 3 is activated.

As a further characteristic, the diving equipment additionally includes a shut-off valve 30 and reset valves 31 and 32, as well as a pre-test valve 3, the respective function of which is now to be described by way of further FIGS. 2 to 5. FIGS. 2 to 5, in this case, show material flows in the form of compressed air as thick arrows, mechanical couplings as thin arrows and signal flows as broken line arrows.

As can be seen in this connection from FIG. 1, the reset valve 31 is coupled mechanically to the outlet valve 4 such that activation of the outlet valve 4 by means of the control element 6 also leads to activation of the reset valve 31. However, said mechanical coupling is developed, in this case, in such a manner that said coupling does not become active until a second half of a possible control region of the control element 6. Therefore, only the outlet valve 4 is activated over the first half of the overall control region of the control element 6, the reset valve 31 also being moved at the same time from a second half of the control region. In the present case, the reset valve 31 is developed as a 2/2 directional control valve, an inlet side of the reset valve 31 branching off from the control line 12 of the emergency valve 9 and an outlet side of the reset valve 31 leading to the jacket 2. As can be seen then in combination with the functional diagram in FIG. 2, a resetting of the time lapse procedure of the time control unit 14 can be achieved by the reset valve 31 by the control line 12 of the emergency valve 9 being relieved of pressure. For in the operating position of the reset valve 31, said valve connects the control line 12 to an unpressurized line to the jacket 2. As a result of said unpressurized connection of the control line 12, the time lapse procedure in the time control unit 14 is consequently also reset at the same time since the control volume 15 is emptied, and as a consequence a monitoring of the breathing activity of the diver is restarted.

A movement of the shut-off valve 30 is additionally also coupled to a movement of the reset valve 31 such that the shut-off valve 30 is also moved into an operating position from a second half of the control region of the control element 6 of the outlet valve 4. The shut-off valve 30, in this case, is also developed as a 2/2 directional control valve and, in the present case, is arranged between the emergency valve 9 and the compressed air bottle 1. In the starting position shown, the shut-off valve 30, in this case, enables compressed air, proceeding from the compressed air bottle 1, to be supplied to the emergency valve 9. If, however, the shut-off valve 30 is then displaced into the operating position, the connection between the emergency valve 9 and the compressed air bottle 1 is interrupted. In the event of unwanted inflation of the jacket 2 in emergency mode, which can occur, for example, when breath is held over a longer period, the diver therefore has the possibility, by means of the shut-off valve 30, of interrupting said unwanted inflation by corresponding activation of the shut-off valve 30. For in this case an inflow to the emergency valve 9 is prevented, as can also be seen from the functional diagram in FIG. 3.

It can also be seen from FIG. 1 that the further reset valve 32 is coupled mechanically with a movement of the inflation valve 3 when the control element 5 is activated. Said reset valve 32, in this case, is developed as a 3/2 directional control valve which, in the starting position shown, connects an inlet of the control valve 23 to the compressed air bottle 1, when an operating position is reached by displacement by means of the control element 5, however, it connects the inlet of the control valve 23 to an unpressurized line to the jacket 2. As a result of said unpressurized connection of the supply to the control valve 23, activation of the control device 23 is reset, in this case, as a control line 34 of the control valve 23, which branches of from the outlet side of the control valve 23, is also connected in an unpressurized manner. As a consequence, the control device 8 is activated by the control valve 23 only if the pressure present at the control line 24 is higher than the pressure prevailing in the reference volume 26 and the pressure provided by the spring element of the control valve 23. Said resetting function, in this connection, can also be seen from the functional diagram in FIG. 4.

Finally, as can be seen in FIG. 1, a pre-test valve 33, which can be transferred manually by means of an operating element 35 from the starting position shown into an operating position, is also provided as another characteristic. Said pre-test valve 33 is developed in the present case as a 3/2 directional control valve and, in the starting position, connects the pressure connection 11 to the control line 24 of the control valve 23. When activated manually by means of the operating element 35 and when reaching the operating position, the control line 24 of the control valve 23 is, however, connected to the compressed air bottle 1, which causes the control valve 23 to transfer directly into the operating position.

The control device 8 is activated accordingly and this independently of a surrounding water pressure such that correct functioning of the control device 8, even above the surface of the water and independent of the criteria otherwise necessary for activation, is able to be checked by means of the pre-test valve 33. As can be seen in combination with the functional diagram from FIG. 5, said pre-function test is then able to be reset once the operating element 35 has been released and as a result of operating the reset valve 32 by means of the control element 5. For otherwise, the control valve 23 would always be held in the operating position as a result of the control line 34 branching off from its outlet side.

In the present case, couplings of the shut-off valve 30 and of the reset valve 31 with the outlet valve 4 and coupling of the reset valve 32 with the inflation valve 3 are provided in a mechanical manner. In terms of the disclosure, however, a hydraulic, pneumatic or electric coupling can also be conceived just as well. In the present case, resetting the emergency valve 9, the bypass valve 20, the shut-off valve 27 and also the control valve 23 is achieved in a pneumatic manner in each case by means of control lines, however, this can also be accomplished in a mechanical, hydraulic or electric manner corresponding to a pressure detected at another point.

By means of the development of an article of diving equipment according to the disclosure, it is consequently possible to influence functions of the control device 8 of the diving equipment in a simple manner. In this case, activation of this type can also be performed by a diving partner, for example a diving teacher.

LIST OF REFERENCES

1 Compressed air bottle
2 Jacket
3 Inflation valve
4 Outlet valve
5 Control element
6 Control element
7 Mouthpiece
8 Control device

9 Emergency valve
10 Control line
11 Pressure connection
12 Control line
13 Control line
14 Time control unit
15 Control volume
16 Fill aperture
17 Drain valve
18 Additional volume
19 Line
20 Bypass valve
21 Operating element
22 Control line
23 Control valve
24 Control line
25 Control line
26 Reference volume
27 Shut-off valve
28 Operating element
29 Control line
30 Shut-off valve
31 Reset valve
32 Reset valve
33 Pre-test valve
34 Control line
35 Operating element

The invention claimed is:

1. An article of diving equipment, comprising:

a compressed air bottle connected to a breathing apparatus;

an inflatable jacket connected in a normal mode to the compressed air bottle for inflation of the jacket and to an outlet for letting out air from the jacket to balance a buoyancy of the jacket;

a control device (i) configured to be activated by a control valve in dependence on a surrounding water pressure and (ii) including a time control unit which, after the expiration of a defined time and if there is an absence of breathing activity in the breathing apparatus, is configured to transfer into an emergency mode in which, via a first control line, the time control unit activates an emergency valve which connects the jacket to the compressed air bottle to force the jacket to inflate;

an inflation valve;

an outlet valve; and at least one regulating valve configured to be activated during a diving operation to influence operation of at least one of the control device and the control valve, wherein the inflation valve, when activated manually, connects the jacket to the compressed air bottle, and the outlet valve, when activated manually, connects the jacket to an outlet, and wherein the activation of the at least one regulating valve is coupled with the activation of at least one of the inflation valve and the outlet valve at least within a defined region of movement of the at least one of the inflation valve and the outlet valve.

2. The article of diving equipment as claimed in claim 1, wherein:

the outlet valve configured to be activated by a control element, and in a first half of a control region of the control element a control movement of the control element is coupled purely with a displacement of the outlet valve, and in a second half of the control region the control movement is additionally coupled with a displacement of the at least one regulating valve.

3. The article of diving equipment as claimed in claim 1, wherein:

the at least one regulating valve is configured as a shut-off valve positioned between the emergency valve and the compressed air bottle, and in an activated position the shut-off valve interrupts the connection between the emergency valve and the compressed air bottle.

4. The article of diving equipment as claimed in claim 1, wherein the at least one regulating valve is configured as a reset valve, to which a working line branches from the control line of the emergency valve and which, in an activated position, relieves pressure from the control line.

5. The article of diving equipment as claimed in claim 1, wherein:

the at least one regulating valve is configured as a reset valve positioned between the control valve and the compressed air bottle, and in a starting position, the reset valve connects a working line of the control valve to the compressed air bottle and, in an activated position, the reset valve relieves pressure from the working line of the control valve.

6. The article of diving equipment as claimed in claim 1, wherein:

the at least one regulating valve includes a shut-off valve arranged between the control valve and the time control unit, the shut-off valve is configured to be moved into a shut-off position in which a connection between the time control unit and the control valve is interrupted, and the shut-off valve produces the connection between the time control unit and the control valve in a starting position, into which the shut-off valve is configured to be transferred by a second control line connected to an outlet side of the inflation valve.

7. The article of diving equipment as claimed in claim 1, wherein:

the at least one regulating valve includes a bypass valve configured to be transferred into an operating position in which a line branching from a control volume of the time control unit is connected to an additional volume, and the bypass valve is configured to interrupt the connection between the line and the additional volume in a starting position, into which the bypass valve is configured to be transferred by a third control line, which is connected to an outlet side of the inflation valve.

8. The article of diving equipment as claimed in claim 1, further comprising:

a pre-test valve including an actuating element, wherein the pre-test valve, in an activated position, connects a fourth control line of the control valve to the compressed air bottle such that the control valve activates the control device.

* * * * *